US008000644B2

(12) United States Patent
Hoshino

(10) Patent No.: US 8,000,644 B2
(45) Date of Patent: Aug. 16, 2011

(54) POWDER TRANSPORTING DEVICE AND IMAGE FORMING APPARATUS

(75) Inventor: Hirohisa Hoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 421 days.

(21) Appl. No.: 12/336,892

(22) Filed: Dec. 17, 2008

(65) Prior Publication Data

US 2009/0257798 A1 Oct. 15, 2009

(30) Foreign Application Priority Data

Apr. 15, 2008 (JP) ..... P2008-106248

(51) Int. Cl.
*G03G 21/10* (2006.01)

(52) U.S. Cl. ..... 399/358; 399/360

(58) Field of Classification Search ..... 399/358
See application file for complete search history.

(56) References Cited

U.S. PATENT DOCUMENTS

| | | | | |
|---|---|---|---|---|
| 6,366,755 | B1 * | 4/2002 | Takashima | 399/254 |
| 6,937,838 | B2 * | 8/2005 | Ishii et al. | 399/358 |
| 7,149,467 | B2 * | 12/2006 | Stickler et al. | 399/358 |
| 7,437,116 | B2 * | 10/2008 | Lee | 399/359 |
| 7,627,274 | B2 * | 12/2009 | Ishiguro et al. | 399/258 |
| 2006/0018690 | A1 * | 1/2006 | Blair et al. | 399/358 |
| 2008/0118290 | A1 * | 5/2008 | Sato | 399/358 |
| 2009/0067873 | A1 * | 3/2009 | Gunbe | 399/99 |
| 2009/0154972 | A1 * | 6/2009 | Tanaka et al. | 399/358 |
| 2009/0324294 | A1 * | 12/2009 | Ichikawa et al. | 399/258 |

FOREIGN PATENT DOCUMENTS

| | | | |
|---|---|---|---|
| JP | 2003-029486 | | 1/2003 |
| JP | 2003-255792 | | 9/2003 |
| JP | 2002-311712 | | 10/2003 |
| JP | 2005-091848 | | 4/2005 |
| JP | 2006276811 | A * | 10/2006 |
| JP | 2007025556 | A * | 2/2007 |

* cited by examiner

*Primary Examiner* — David M Gray
*Assistant Examiner* — David Bolduc
(74) *Attorney, Agent, or Firm* — Morgan, Lewis & Bockius LLP

(57) ABSTRACT

A powder transporting device includes a drop path that allows powder to drop, a first crushing member that is located in the drop path and crushes the powder cohesion in the drop path by reciprocating along the drop path, and a second crushing member that located in the drop path that crushes the powder cohesion in the drop path by reciprocating along the drop path, wherein when the first crushing member moves toward a downstream side in a dropping direction of the powder in the drop path, a tip of the first crushing member at the downstream side in a dropping direction is inclined to a side where the second crushing member is located, and comes in contact with the second crushing member.

20 Claims, 9 Drawing Sheets

UH1
UH2
UH3
IVB
IVC
101
101a
101b
101c
101d
101e
102
103c
103k
103m
103y
104c
104k
104m
104y
106y
107
107a
107b
111
112
112a
112b
112c
112d
112e
113a
113b
113c
113d
113e
114
114a
114b
121
122
122a
122b
226a
301
302
303
304
G101
G102
G103
G111
G112
G113
G121
G122
G123
G131
G132
G133
G141
G142
G143
X
Y
Z
(−X)
(−Y)
(−Z)

201
211
212
213
221
222
222a
222b
222c
222d
222e
222f
223
223a
223b
223c
224
225
226
226a
226b
227
227a
227b
227c
227d
228
228a
228b
229
229a
229b
VB
VC
VD
D
P
X
(-X)
Y
(-Y)
Z
(-Z)

227
227b
227c
227d
228
228a
228b
229
229a
229b

POWDER TRANSPORTING DEVICE AND IMAGE FORMING APPARATUS

CROSS-REFERENCE TO RELATED APPLICATION

This application is based on and claims priority under 35 USC 119 form Japanese Patent Application No. 2008-106248 filed Apr. 15, 2008.

BACKGROUND

Technical Field

The present invention relates to a powder transporting device and an image forming apparatus. The invention is applied to transporting a powder. Particularly the invention is useful for a developer. The powder may be chemical, resin powder, pigment or abrasive. The average particle diameter of powder is preferably from 1 μm to 500 μm.

SUMMARY

According to an aspect of the invention, a powder transporting device includes a drop path that allows powder to drop, a first crushing member that is located in the drop path and crushes the powder cohesion in the drop path by reciprocating along the drop path, and a second crushing member that located in the drop path that crushes the powder cohesion in the drop path by reciprocating along the drop path, wherein when the first crushing member moves toward a downstream side in a dropping direction of the powder in the drop path, a tip of the first crushing member at the downstream side in a dropping direction is inclined to a side where the second crushing member is located, and comes in contact with the second crushing member.

BRIEF DESCRIPTION OF THE DRAWINGS

Exemplary embodiments of the invention will be described in detail based on the following figures, wherein.

DETAILED DESCRIPTION

Figure 1:
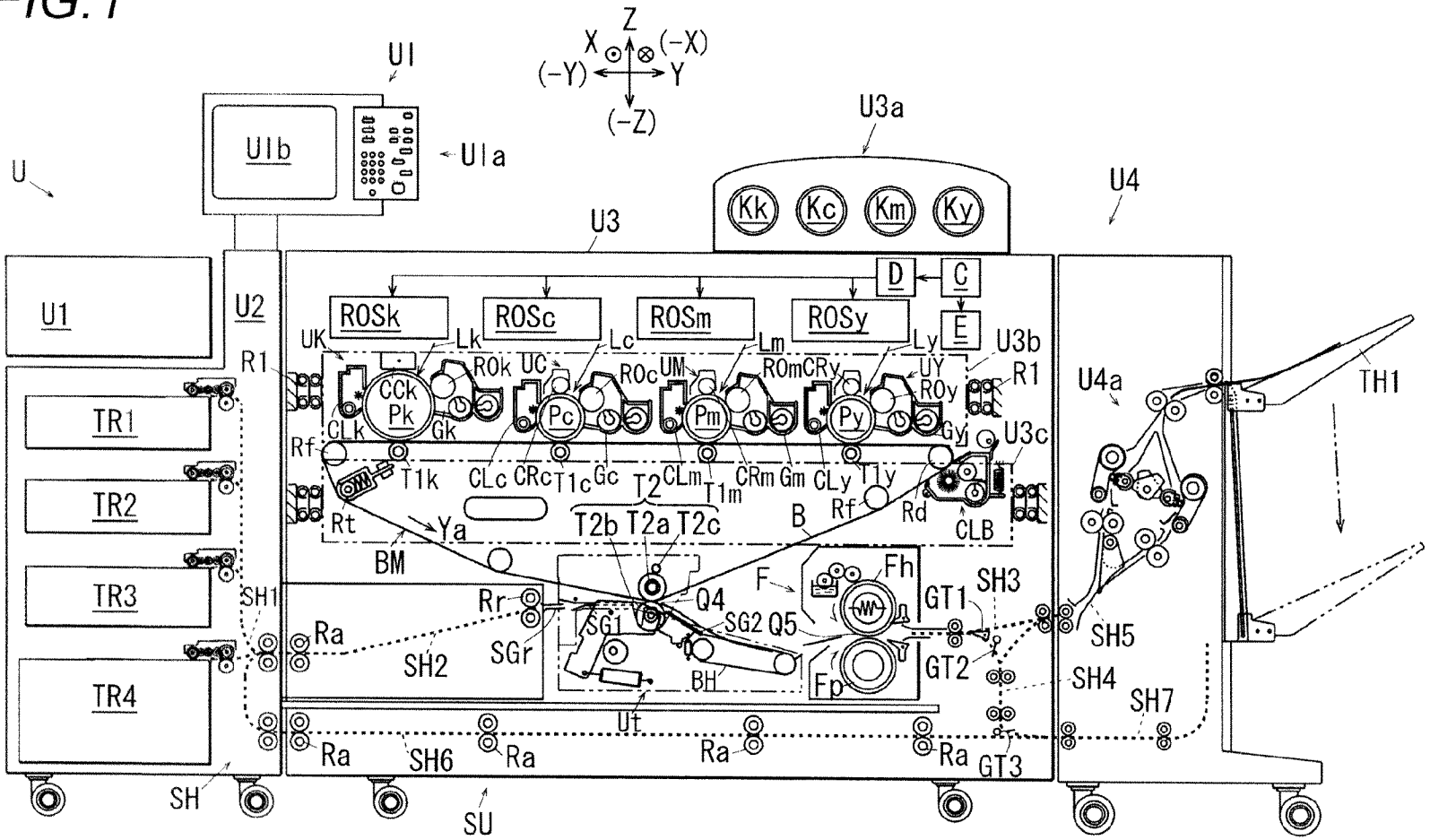
FIG. 1 is an explanatory overall view of an image forming apparatus according to an example 1 of the present invention.

The exemplary examples (hereinafter referred to as examples) of the present invention will be described below with reference to the drawings, though the examples are not limited to the following.

To facilitate the understanding of the following explanation, in the drawings, the longitudinal direction is X-axis direction, the lateral direction is Y-axis direction and the vertical direction is Z-axis direction, and the direction or side as indicated by the arrow X, −X, Y, −Y, Z or −Z is defined as forward, backward, rightward, leftward, upward, downward, or front side, back side, right side, left side, upper side or lower side.

Also, in the drawings, sign "·" in "○" denotes the arrow directed from the back of paper to the front and sign "×" in "○" denotes the arrow directed from the front of paper to the back.

In the following explanation with the drawings, to facilitate the understanding, the members other than required for explanation are appropriately omitted.

FIG. 1 is an explanatory overall view of an image forming apparatus according to an example 1 of the invention.

In FIG. 1, a copying machine U as one example of the image forming apparatus has an operation unit UI, an image input device U1, a medium supply device U2, an image forming apparatus main body U3 and a paper processing device U4.

(Operation Unit)

The operation unit UI has an input button UIa for use to start copying or set the number of copies. Also, the operation unit UI has a display unit UIb for displaying the contents inputted by the input button UIa or a state of the copying machine U.

(Image Input Device)

The image input device U1 includes an automatic original conveying device and an image reading device. The image input device U1 applies a light to the arranged original document, receives its reflected light through a solid-state image sensor, converts the light into image information of red R, green G and blue B, and inputs the image information into the image forming apparatus main body U3 at a predetermined time, or so-called timing.

(Medium Supply Device)

The medium supply device U2 has a plurality of paper feed trays TR1, TR2, TR3 and TR4 as one example of a medium storage container. Also, the medium supply device U2 has a medium supply path SH1 for picking up the recording sheet S as one example of the image recording medium stored in each of the paper feed trays TR1 to TR4, and conveying the recording sheet S to the image forming apparatus main body U3.

(Image Forming Apparatus Main Body)

In FIG. 1, the image forming apparatus main body U3 has an image recording part for recording the image on the recording sheet S conveyed from the medium supply device U2, a developer supply device U3*a*, and a paper conveying path SH2, a paper exhaust path SH3, a paper inversion path SH4 and a paper circulation path SH6.

Also, the image forming apparatus main body U3 has a control part C and a laser drive circuit D and a power supply circuit E as one example of a latent image forming device driving circuit that is controlled by the control part C. The laser drive circuit D converts image information of red R, green G and blue B inputted from the image input device U1 into image information of Y (yellow), M (magenta), C (cyan) and K (black), and outputs a corresponding drive signal to a latent image forming device of each color ROSy, ROSm, ROSc and ROSk at a predetermined timing.

Under the latent image forming device of each color ROSy, ROSm, ROSc and ROSk, a visible image forming device drawer U3*b* as one example of a drawer member is supported to be movable between a drawn position where it is drawn forward of the image forming apparatus main body U3 and an installed position where it is installed inside the image forming apparatus main body U3 on the slide rails R1, R1 as one example of one pair of left and right guide members.

Figure 2:
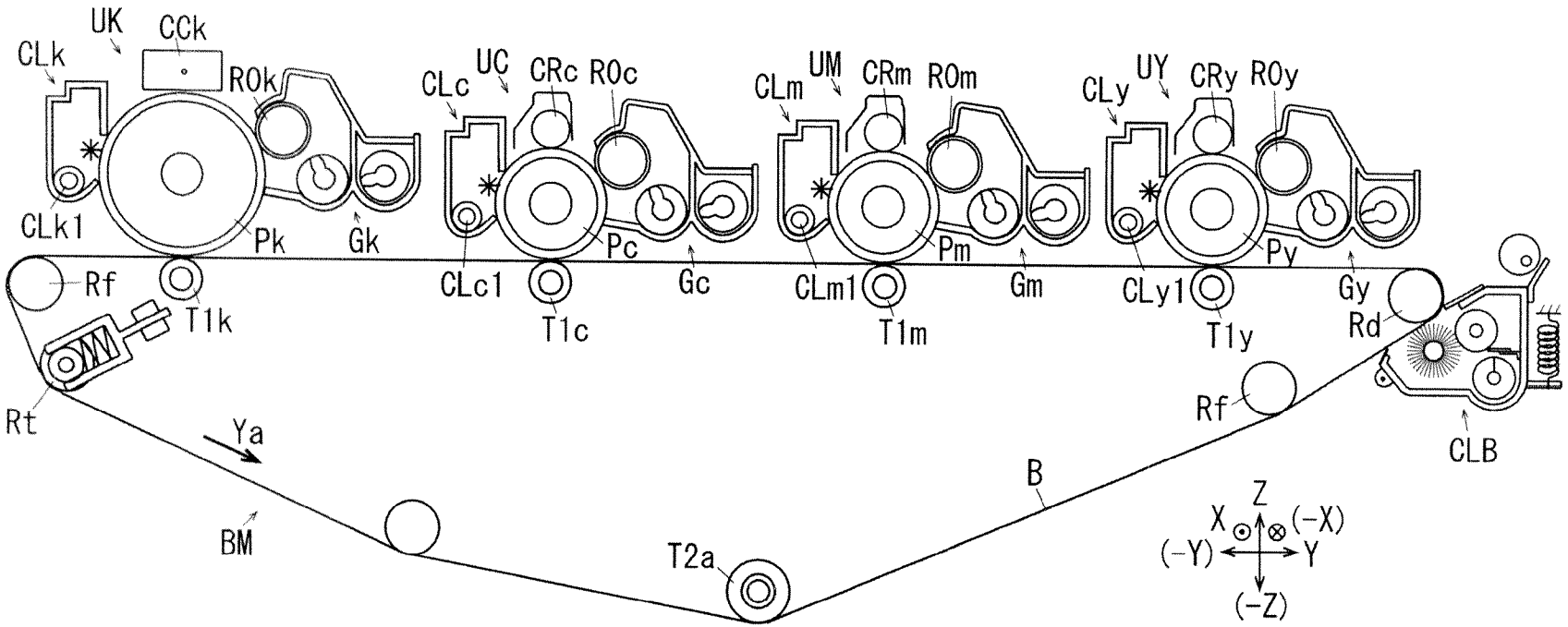
FIG. 2 is an explanatory enlarged view of a visible image forming device and an intermediate transfer body cleaner unit.

FIG. 2 is an explanatory enlarged view of a visible image forming device and an intermediate transfer body cleaner unit.

In FIGS. 1 and 2, a photoconductor unit UK of K color as one example of an image bearing member unit has a photoconductor drum Pk as one example of an image bearing member, a charging corotron CCk as one example of a charger unit, and a cleaner CLk as one example of an image bearing member cleaner unit. And the photoconductor units UY, UM and UC of other colors Y, M and C have the photoconductor drums Py, Pm and Pc, the charging rolls CRy, CRm and CRc as one example of the charger unit, and the cleaners CLy, CLm and CLc.

The visible image forming device UK+GK of K color is composed of the photoconductor unit UK of K color and the developing device GK having the developing roll R0*k*. Similarly, the visible image forming devices UY+GY, UM+GM and UC+GC of Y color, M color and C color are composed of the photoconductor unit UY of Y color, the photoconductor unit UM of M color and the photoconductor unit UC of C color, and the developing device GY having the developing roll R0*y*, the developing device GM having the developing roll R0*m* and the developing device GC having the developing roll R0*c*.

The photoconductor units UY, UM, UC and UK and the developing devices GY, GM, GC and GK are detachably attached on the visible image forming device drawer U3*b*.

In FIGS. 1 and 2, the photoconductor drum Pk of K color is more frequently used than the photoconductor drums Py to Pc of other colors and has greater surface abrasion because the image output of only K color is mostly made. Therefore, the diameter of the photoconductor drum Pk is larger than the other photoconductor drums Py to Pc.

Also, the charging corotron CCk of K color is composed of a discharge member for charging, not the contact-type charging member such as the charging rolls of Y, M and C, CRy, CRm and CRc, to charge the photoconductor drum Pk at high speed in outputting the image of K color only at high speed.

In FIG. 1, the photoconductor drum Py, Pm, Pc and Pk is uniformly charged by the charging roll CRy, CRm, CRc and the charging corotron CCk, and has an electrostatic latent image formed on the surface by a laser beam Ly, Lm, Lc and Lk as one example of a latent image writing light that the latent image forming device ROSy, ROSm, ROSc and ROSk outputs. The electrostatic latent image on the surface of the photoconductor drum Py, Pm, Pc and Pk is developed into the toner image as one example of the visible image of Y (yellow), M (magenta), C (cyan) and K (black) color by the developing device Gy, Gm, Gc and Gk.

In the developing devices GK to GY, the developer consumed by development is supplied from the toner cartridge Kk, Km, Kc and Ky as one example of the developer storage container removably mounted on the developer supply device U3*a*. In an example 1, the two-component developer containing the toner as the developer and the carrier is employed, in which a so-called high density developer having a higher percentage of toner than the toner density of the developing devices GK to GY is supplied from the toner cartridges Kk, Km, Kc and Ky. Accordingly, in the developing devices GK to GY of the example 1, while the high density developer containing a small amount of carrier is supplied, the developer containing the depleted carrier is discharged little by little from the developing devices GK to GY to exchange the carrier. Such a technique for exchanging the carrier little by little is conventionally well known, and was described in JP-A-2000-81787 and JP-A-2003-84570, for example, and the detailed explanation thereof is omitted.

The toner images on the surface of the photoconductor drums Py, Pm, Pc and Pk are transferred successively onto an intermediate transfer belt B as one example of an intermediate transfer body by the primary transfer rolls T1*y*, T1*m*, T1*c* and T1*k* as one example of a primary transfer unit, whereby a multi-color image is formed on the intermediate transfer belt B. A color toner image as one example of a multi-color visible image formed on the intermediate transfer belt B is carried to a secondary transfer area Q4.

In the case of only the image information of K color, the photoconductor drum Pk of K color and the developing device GK are only employed, whereby the toner image of K color only is formed.

After the primary transfer, the residual developer or residual paper powder adhering to the surface of the photoconductor drums Pk, Pc, Pm and Py is removed by the cleaners CLk, CLc, CLm and CLy. And the residue removed from the photoconductor drums Pk to Pc is carried out of the cleaners CLk to CLy by the residue carrying member CLk1, CLc1, CLm1 and CLy1 provided under the cleaners CLk, CLc, CLm and CLy, and carried behind the image forming apparatus main body U3.

Under the visible image forming device drawer U3*b*, an intermediate transfer device drawer U3*c* as one example of a drawer member is supported to be movable between a drawn position where it is drawn forward of the image forming apparatus main body U3 and an installed position where it is installed inside the image forming apparatus main body U3. A belt module BM as one example of the intermediate transfer device is supported to ascend or descend between an ascent position in contact with the lower surface of the photoconductor drums Py, Pm, Pc and Pk and a descent position downward away from the lower surface by the intermediate transfer device drawer U3*c*.

The belt module BM has the intermediate transfer belt B, a belt support roll Rd+Rt+Rw+Rf+T2*a* as one example of an intermediate transfer member support member composed of a drive roll Rd as one example of an intermediate transfer drive member, a tension roll Rt as one example of a tension generation member, a walking roll Rw as one example of a meandering prevention member, a plurality of idler rolls Rf as one example of a follower member, a backup roll T2*a* as one example of a secondary transfer opposing member, and the primary transfer rolls T1*y*, T1*m*, T1*c* and T1*k*. And the intermediate transfer belt B is supported to be rotationally moved in the direction of the arrow Ya by the belt support roll Rd+Rt+Rw+Rf+T2*a*.

The secondary transfer unit Ut is arranged under the backup roll T2*a*. A secondary transfer roll T2*b* as one example of the secondary transfer member of the secondary transfer unit Ut can be separated away from or pressed against the backup roll T2*a* across the intermediate transfer belt B whereby the secondary transfer area Q4 is formed from an area where the secondary transfer roll T2*b* is pressed against the intermediate transfer belt B. Also, the backup roll T2*a* is contacted by the contact roll T2*c* as one example of a contact feeding member. A secondary transfer voltage having the same polarity as the charging polarity of toner is applied at a predetermined timing from the power supply circuit E controlled by the control part C to the contact roll T2*c*.

A secondary transfer unit T2*a*+T2*b*+T2*c* is composed of the backup roll T2*a*, the secondary transfer roll T2*b* and the contact roll T2*c*.

A sheet conveying path SH2 is arranged under the belt module BM. The recording sheet S supplied from a medium supply path SH1 of the medium supply device U2 is conveyed to a registration roll Rr as one example of a conveying timing adjustment member of the sheet conveying path SH2, and further conveyed through a registration side sheet guide SGr and a pre-transfer sheet guide SG2 as one example of the guide member to the secondary transfer area Q4 in timing for carrying the color toner image to the secondary transfer area Q4.

The registration side sheet guide SGr is fixed to the image forming apparatus main body U3 together with the registration roll Rr.

The color toner image on the intermediate transfer belt B is transferred onto the recording sheet S by the secondary transfer unit T2*a*+T2*b*+T2*c* in passing through the secondary transfer area Q4. In the case of the multi-color image, the toner images primarily transferred onto the surface of the intermediate transfer belt B are secondarily transferred collectively onto the recording sheet S.

The transfer device T1*y* to T1*k*+T2*a*+T2*b*+T2*c*+B of the example 1 is composed of the primary transfer roll T1*y* to T1*k*, the secondary transfer unit T2*a*+T2*b*+T2*c* and the intermediate transfer belt B.

The intermediate transfer belt B after the secondary transfer is cleaned by the belt cleaner CLB as one example of the intermediate transfer body cleaner unit provided to the lower right of the intermediate transfer belt B. The residue such as residual developer or paper powder on the intermediate transfer belt B, which is not used at the time of secondary transfer, is removed from the intermediate transfer belt B by the belt cleaner CLB, and carried behind the image forming apparatus main body U3. The secondary transfer roll T2*b* and the belt cleaner CLB can be separated away from or contacted with the intermediate transfer belt B.

The recording sheet S to which the toner image is secondarily transferred is conveyed through the a post-transfer sheet guide SG2, and the medium conveying belt BH as one example of the conveying member to a fixing area Q5 that is an area where a fixing roll Fh of the fixing device F and a pressing roll Fp as one example of the pressing fixing member are pressed and contacted. The toner image on the recording sheet S is heated and fixed by the fixing device F in passing through the fixing area Q5. A switch gate GT1 as one example of a switching member is provided on the downstream side of the fixing device F. The switching gate GT1 selectively switches the recording sheet S conveyed on the sheet conveying path SH2 and heated and fixed in the fixing area Q5 to either the sheet exhaust path SH3 or the sheet inversion path SH4 of the sheet processing device U4 in accordance with an instruction of the user. The sheet S conveyed to the sheet exhaust path SH3 is conveyed to the sheet conveying path SH5 of the sheet processing device U4, where a so-called curl that is a warp of the sheet S is corrected by a curl correction member U4*a* as one example of a medium warp correction member arranged on the sheet conveying path SH5, and exhausted from an exhaust roll Rh as one example of the medium exhaust member into an exhaust tray TH1 as one example of the medium exhaust part of the sheet processing device U4, with the image fixed side of the sheet faced up.

The sheet S conveyed to the side of the sheet inversion path SH4 of the image forming apparatus main body U3 via the switching gate GT1 is conveyed through a Mylar gate GT2 as one example of a flexible switching member to the sheet inversion path SH4 of the image forming apparatus main body U3.

At this time, in the case where the recording sheet S is exhausted with the image fixed surface down, the recording sheet S is turned over immediately after the trailing edge of the recording sheet S passes through the Mylar gate GT2. In this case, the Mylar gate GT2 directly passes the recording sheet S conveyed to the sheet inversion path SH4, and after the passing recording sheet S is turned over, conveys the passing recording sheet S to the side of the sheet conveying paths SH3 and SH5. And the recording sheet S is exhausted into the exhaust tray TH1 with the image fixed surface down.

The sheet circulation path SH6 is connected in the middle of the sheet inversion path SH4 of the image forming apparatus main body U3, and a Mylar gate GT3 is arranged at the connection. A downstream end of the sheet inversion path SH4 of the image forming apparatus main body U3 is connected to the sheet inversion path SH7 of the sheet processing device U4.

The recording sheet S conveyed through the switching gate GT1 to the sheet conveying path SH4 is conveyed to the sheet inversion path SH7 of the sheet processing device U4 by the Mylar gate GT3. The Mylar gate GT3 directly passes the recording sheet S conveyed to the sheet inversion path SH4, and after the passing recording sheet S is turned over, conveys the passing recording sheet S to the side of the sheet circulation path SH6.

The recording sheet S conveyed to the sheet circulation path SH6 is fed again through the sheet feed path SH1 to the transfer area Q4 for printing on both sides, conveyed to the sheet processing device U4, and exhausted into the exhaust tray TH1.

The sheet conveying path SH is composed of the elements as indicated by the signs SH1 to SH7. Also, the sheet conveying device SU is composed of the elements as indicated by the signs SH, Ra, Rr, Rh, SGr, SG1, SG2, BH, and GT1 to GT3.

(Waste Developer Carrying Device)

Figure 3:
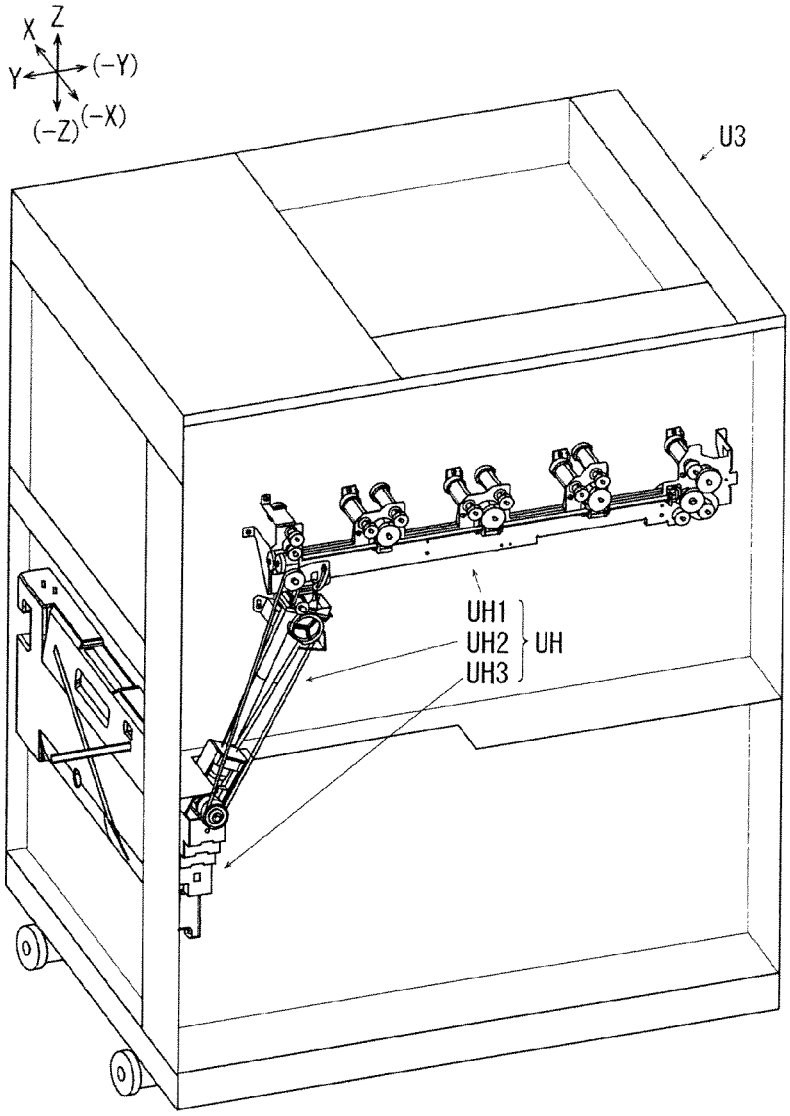
FIG. 3 is an essential perspective view of a waste developer carrying device and an image forming apparatus main body according to the example 1, as seen from the back.

FIG. 3 is an essential perspective view of a waste developer carrying device and the image forming apparatus main body according to the example 1, as seen from the back.

Figures 4A, 4B, 4C:
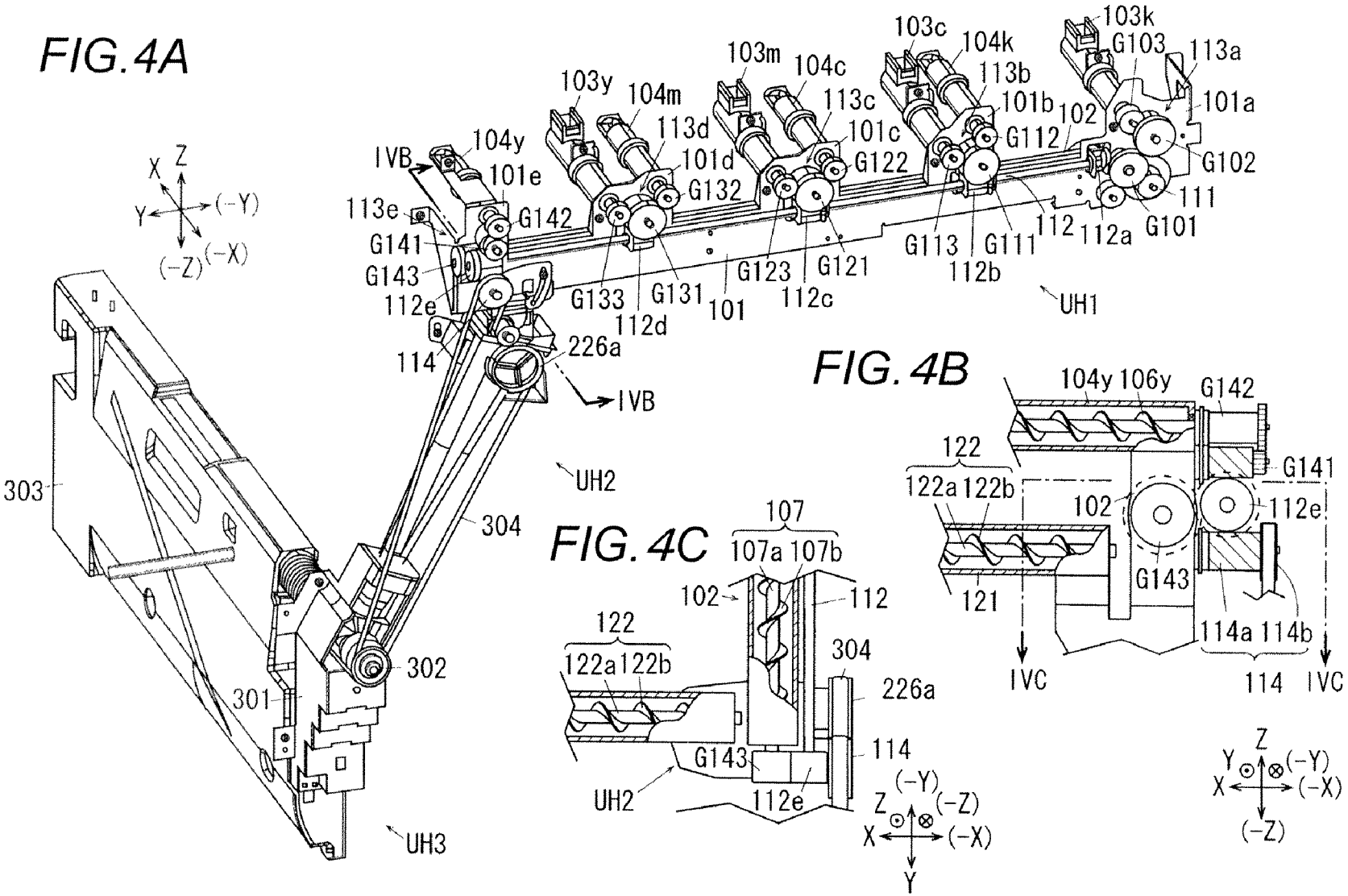
FIG. 4A is a perspective view of the waste developer carrying device.
FIG. 4B is an essential cross-sectional view taken along the line IVB-IVB in FIG. 4A.
FIG. 4C is an essential cross-sectional view taken along the line IVC-IVC in FIG. 4B.

FIG. 4A is an explanatory view of the waste developer carrying device according to the example 1, FIG. 4B is an essential cross-sectional view taken along the line IVB-IVB in FIG. 4A, and FIG. 4C is an essential cross-sectional view taken along the line IVC-IVC in FIG. 4B.

From FIG. 3 to FIG. 4C, the waste developer carrying device UH as one example of the developer carrying apparatus is supported on the back of the image forming apparatus main body U3. The waste developer carrying device UH has an image forming apparatus carrying portion UH1 for carrying the developer discharged from the image forming apparatus main body U3, a drop-off carrying portion UH2 for carrying the developer from the image forming apparatus carrying portion UH1, and a waste developer withdrawal portion UH3 for withdrawing the developer passing through the drop-off carrying portion UH2.

The image forming apparatus carrying portion UH1 has a main frame 101 as one example of a framework extending in the lateral direction. The main frame 101 is formed with carrying path connection portions 101*a*, 101*b*, 101*c*, 101*d* and 101*e* spaced at a predetermined interval in the lateral direction in order from the left.

The photoconductor carrying path 109 as one example of a second developer carrying path extending along the main frame 101 is supported on the main frame 101. On the first carrying path connection portion 101*a*, a cleaner unit carrying path 103*k* extending from the cleaner CLk of the visible image forming device UK+GK of K color is supported in a state where it is connected to cross above the photoconductor carrying path 102. On the second carrying path connection portion 101*b* a developing device carrying path 104*k* extending from the photoconductor drum Pk of the visible image forming device UK+GK of K color and the cleaner unit carrying path 103*c* extending from the cleaner CLc of the visible image forming device UC+GC of C color are supported in a state where they are connected to cross above the photoconductor carrying path 102.

Similarly, the developing device carrying path 104*c* of C color and the cleaner unit carrying path 103*m* of M color connected to the photoconductor carrying path 102 are supported on the third carrying path connection portion 101*c*, and the developing device carrying path 104*m* of M color and the cleaner unit carrying path 103*y* of Y color connected to the photoconductor carrying path 102 are supported on the fourth carrying path connection portion 101*d*. And on the fifth carrying path connection portion 101*e*, the developing device carrying path 104*y* of Y color is supported in a state where it is connected to cross above the photoconductor carrying path 102.

In FIG. 4, a drive gear 111 as one example of the drive gear is supported on the left rear side of the first carrying path connection portion 101*a* of the main frame 101. The drive gear 111 is rotated by a drive motor, not shown. Also, a transmission gear G101 as one example of the transmission gear meshing with the drive gear 111 is supported on the first carrying path connection portion 101*a*. A transmission gear G102 supported on the first carrying path connection portion 101*a* meshes with the transmission gear G101. Also, the transmission gear G102 meshes with a cleaner unit discharge gear G103 of K color for transmitting the driving to a carrying member, not shown, within the cleaner unit carrying path 103*k* of K color.

A shaft 112 as one example of the drive transmission member extending along the photoconductor carrying path 102 is supported on the main frame 101. A gear 112*a* as one example of the gear member meshing with the transmission gear G101 is supported at the left end of the shaft 112. Also, the intermediate gears 112*b* to 112*e* as one example of the intermediate gear are supported at the positions corresponding to the second to fifth carrying path connection portions 101*b* to 101*e* on the shaft 112. A second transmission gear G111 supported on the second carrying path connection portion 101*b* meshes with the first intermediate gear 112*b*. The second transmission gear G111 meshes with a developing device discharge gear G112 of K color for transmitting the driving to the carrying member, not shown, within the developing device carrying path 104*k* of K color and a cleaner unit discharge gear G113 of C color for transmitting the driving to the carrying member, not shown, within the cleaner unit carrying path 103*c* of C color.

Similarly, a third transmission gear G121 on the third carrying path connection portion 101*c* meshes with the second intermediate gear 112*c*, and the third transmission gear G121 meshes with a developing device discharge gear G122 of C color on the developing device carrying path 104*c* of C color and a cleaner unit discharge gear G123 of M color on the cleaner unit carrying path 103*m* of M color. A fourth transmission gear G131 on the fourth carrying path connection portion 101*d* meshes with a third intermediate gear 112*d*, and the fourth transmission gear G131 meshes with a developing device discharge gear G132 of M color on the developing device carrying path 104*m* of M color and a cleaner unit discharge gear G133 of Y color on the cleaner unit carrying path 103*y* of Y color.

In FIG. 4, a fifth transmission gear G141 supported on the fifth carrying path connection portion 101*e* meshes with the fourth intermediate gear 112*e*, and the fifth transmission gear G141 meshes with a developing device discharge gear G142 of Y color for transmitting the driving to a carrying member 106*y* on the developing device carrying path 104*y* of Y color. Further, a photoconductor carrying path gear G143 for transmitting the driving to a photoconductor carrying path auger 107 as one example of the second carrying member within the photoconductor carrying path 102 meshes with a fifth intermediate gear 112*e*. In the example 1, a spiral carrying blade 107*b* is supported on the outer periphery of a rotation shaft 107*a* of the photoconductor carrying path auger 107. The carrying blade 107*b* is spirally wound clockwise in the carrying direction, and the photoconductor carrying path gear G143 is set to be rotated in the clockwise direction in FIG. 4B.

And a belt driving member 114 as one example of the driving transmission member for the drop-off carrying part UH2 is arranged under the fifth intermediate gear 112*e*. The belt drive member 114 has a gear portion 114*a* as one example of a transmitted portion meshing with the fourth intermediate gear 112*e* and a pulley portion 114*b* as one example of an endless member drive transmission member integrally rotated with the gear portion 114*a*.

In FIGS. 4B and 4C, on the lower front side of the fifth carrying path connection portion 101*e*, an intermediate transfer body carrying path 121 as one example of the first developer carrying path for carrying the residue from the belt cleaner CLB for the intermediate transfer body extends back from the belt cleaner CLB. A belt cleaner auger 122 as one example of the first developer carrying member is provided on the intermediate transfer body carrying path 121, and driven by a drive motor, not shown. In the example 1, a spiral carrying blade 122*b* is supported on the outer periphery of a rotation shaft 122*a* of the belt cleaner auger 122 The carrying blade 122*b* is spirally wound clockwise in the carrying direction, and set to be rotated in the clockwise direction as seen from the back.

Figures 5A, 5B, 5C, 5D:
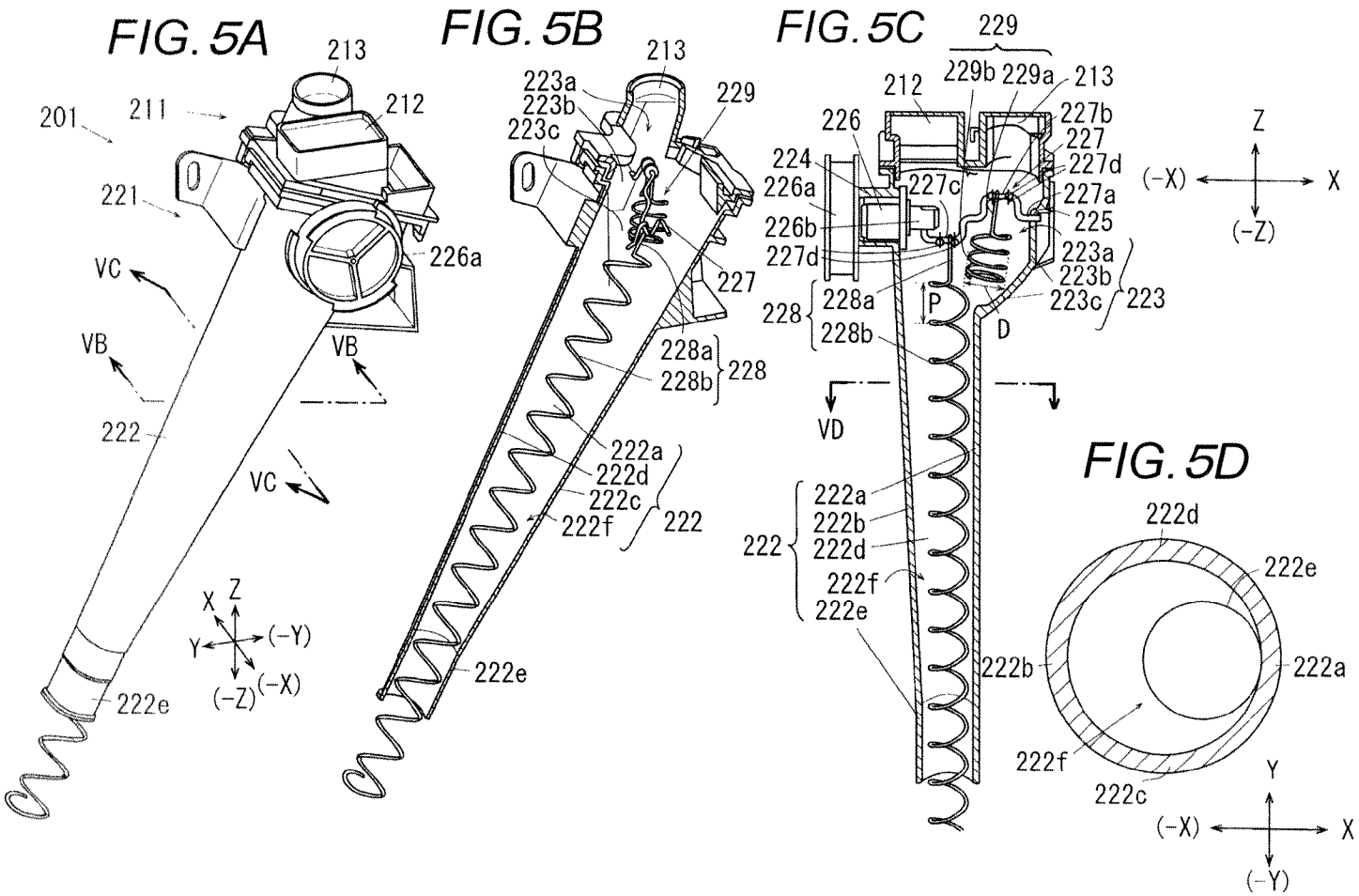
FIG. 5A is an enlarged perspective view of the essence of a gravity drop-off portion in the waste developer carrying device.
FIG. 5B is a cross-sectional view taken along the line VB-VB in FIG. 5A.
FIG. 5C is a cross-sectional view taken along the line VC-VC in FIG. 5A.
FIG. 5D is a cross-sectional view taken along the line VD-VD in FIG. 5C.

FIGS. 5A to 5D are an essential explanatory view of a gravity drop-off portion in the waste developer carrying device, in which FIG. 5A is a perspective view, FIG. 5B is a cross-sectional view taken along the line VB-VB in FIG. 5A, FIG. 5C is a cross-sectional view taken along the line VC-VC in FIG. 5A, and FIG. 5D is a cross-sectional view taken along the line VD-VD in FIG. 5C.

In FIGS. 4A to 5D, the drop-off carrying portion UH2 has a drop-off carrying portion main body 201 like a truncated cone having a smaller diameter on the lower side than the upper side, extending roughly vertically. The drop-off carrying portion main body 201 has an inflow port portion 211 on the upper side and a carrying portion 221 formed integrally under the inflow port portion 211.

In FIGS. 4A to 5D, a second inflow port 212 protruding upward is formed behind the inflow port portion 211. The second inflow port 212 is like a cylinder having a rectangular opening that is long in the longitudinal direction, and the photoconductor carrying path 102 extending from the left is connected to the second inflow port 212. Also, a first inflow port 213 like a cylinder protruding upward is formed in the front of the inflow port portion 211. The intermediate transfer body carrying path 121 extending from the front is connected to the first inflow port 213.

The carrying portion 221 under the inflow port portion 211 has a second carrying barrel 222 as one example of the second carrying member arranged under the second inflow port 212. The second carrying barrel 222 is formed like a downward cone inclined in the direction from the upper left to the lower right, and has a front wall portion 222*a*. a back wall portion 222*b*, a left wall portion 222*c*, a right wall portion 222*d*, which are like circular arc, and a circular delivery pipe portion 222*e* at the lower end. In FIGS. 5C and 5D, the second carrying barrel 222 is formed like a cone in which the center of circle in cross section is deviated forward on the lower part. That is, in the example 1, the front wall portion 222*a* extends to the circular delivery pipe portion 222*e* without being inclined back or forth and the back wall portion 222*b* inclines forward as extending to the lower part. A main carrying path 222*f* as one example of the second drop-off path is formed by an internal space surrounded by the front wall portion 222*a*, the back wall portion 222*b*, the left wall portion 222*c*, the right wall portion 222*d* and the circular delivery pipe portion 222*e*.

A first carrying wall 223 as one example of the first carrying portion arranged under the first inflow port 213 is formed on the upper front of the second carrying barrel 222. The first carrying wall 223 is formed internally with a sub-carrying path 223*a* as one example of the first drop-off path. The sub-carrying path 223*a* mutually communicates to an upper end portion of the main carrying path 222*f*. In FIG. 5C, the first carrying wall 223 has a first vertical wall 223*b* like a barrel formed along the vertical direction under the first inflow port 213, and a first inclined wall 223*c* formed like a downward cone from the lower end of the first vertical wall 223*b* and connected inclinedly toward the front wall portion 222*a* of the second carrying barrel 222. In the example 1, the inclination of the first inclined wall 223*c* is gentler than the inclination of the second carrying barrel 222.

A back side bearing portion 224 that penetrates in the longitudinal direction is formed in the back wall portion 222*b* of the second carrying barrel 222. And a front side bearing portion 225 is formed at a position opposed to the back side bearing portion 224 of the first vertical wall 223*b*. A shaft support member 226 as one example of a crushing member driving transmission member is supported on the back wall portion 222*b*. A pulley 226*a* as one example of the driven transmission member is formed at an outer end portion outside the back wall portion 222*b* in the shaft support member 226, and a crank support portion 226*b* as one example of the shaft support portion is formed at an inner end portion inside the main carrying path 222*f*.

One end of a crank 227 as one example of a holding member is support rotatably on the front side bearing portion 225. Also, the other end of the crank 227 is fixed and supported in the crank support portion 226*b* of the shaft support member 226, and rotated integrally with the shaft support member 226.

The crank 227 has a rotational center portion 227*a* as one example of a rotational shaft portion supported on the front side bearing portion 225. A first coil spring support portion 227*b* supporting a first coil spring 229 as one example of the first crushing member corresponding to the sub-carrying path 223*a* and bent in the convex shape to protrude diametrically to the rotational center portion 227*a* is formed at the back end of the rotational center portion 227*a*. A second coil spring support portion 227*c* supporting a second coil spring 228 as one example of the second crushing member arranged at a position corresponding to the main carrying path 222*f* and having a different phase of 180° from the first coil spring support portion 227*b* around the rotational center portion 227*a*, and bent in the convex shape to protrude diametrically to the rotational center portion 227*a* is formed at the back end of the first coil spring support portion 227*b*. Accordingly, the crank 227 is composed of a so-called double crank shaft. A pair of coil spring movement regulation members 227*d* opposed with a predetermined spacing is fixed and supported on the first coil spring support portion 227*b* and the second coil spring support portion 227*c*.

The second coil spring 228 is supported on the second coil spring support portion 227*c*. At an upper end of the second coil spring 228, the second crushing portion 228*a* in the shape of an R-character, or a so-called hair pin, as one example of the second supported portion is formed to hook on to the second coil spring support portion 227*c*. The hook portion 228*a* has a larger inner diameter than the outer diameter of the second coil spring support portion 227*c*. and is supported with a play. Accordingly, the second coil spring 228 is supported to be movable longitudinally, namely, in the axial direction of the crank 227 between the coil spring movement regulation members 227*d*. A second coil spring main body

228*b* as one example of the second crushing member main body, around which the wire rod is spirally wound, is formed at a lower end of the hook portion 228*a*.

In the example 1, the second coil spring main body 228*b* is formed to be wound clockwise (hereinafter right-handed twining) downward in the gravitational direction, as seen from above in the gravitational direction, in a state where a pulley 226 as one example of driving transmission member for transmitting a driving force to the crank 227 is arranged on the right side of the crank 227. Also, the second coil spring main body 228*b* extends along the second carrying barrel 222 and has a diameter corresponding to the inner diameter of the circular delivery pipe portion 222*e* of the second carrying barrel 222. Further, the second coil spring main body 228*b* is set to such a length that the lower end of the second coil spring main body 228*b* projects from the lower end of the second carrying barrel 222 even at a so-called top dead center, when the second coil spring 228 is moved to the top part. Accordingly, since the outer diameter of the second coil spring main body 228*b* corresponds to the inner diameter of the circular delivery pipe portion 222*e* at the lower end, the lower end of the second coil spring 228*b* contacts the circular delivery pipe portion 222*e*, whereby the second coil spring 228 having the second hook portion 228*a* supported to be freely movable in the axial direction with a play on the crank 227 is arranged in an inclined state along the front wall portion 222*a*.

The first coil spring 229 is supported on the first coil spring support portion 227*b*. At an upper end of the first coil spring 229, the first hook portion 229*a* like the second hook portion 228*a* as one example of the first supported portion is formed to hook on to the first coil spring support portion 227*b* in the same manner as the second hook portion 228*a*. Accordingly, the first coil spring 229, like the second coil spring 228, is supported to be movable in the axial direction of the crank 227.

The first coil spring main body 229*b* around which the wire rod is wound spirally is formed at the lower end of the hook portion 229*a*. The first coil spring main body 229*b* of the example 1 is formed to be wound counterclockwise (hereinafter left-handed twining) downward in the gravitational direction, as seen from above in the gravitational direction, in a state where the pulley 226 as one example of driving transmission member for transmitting a driving force to the crank 227 is arranged on the right side of the crank 227. The diameter D of the first coil spring main body 229*b* is set to be larger than the interval of winding, or a so-called pitch P, around the second coil spring main body 228*b*. Also, the first coil spring main body 229*b* is set to such a length that the lower end of the first coil spring main body 229*b* can contact the first inclined wall 223*c* of the first carrying wall 223 at a so-called top dead center, when the first coil spring support portion 227*b* is rotated to the upper end in the gravitational direction, and the lower end of the first coil spring main body 229*b* can be guided along the first inclined wall 223*c* to enter the main carrying path 222*f* and cross the second coil spring main body 228*b* of the main carrying path 222*f* at a so-called bottom dead center, when the first coil spring support portion 227*b* is rotated to the lower end in the gravitational direction.

The waste developer withdrawal portion UH3 to which the main carrying path 222*f* of the drop-off carrying portion UH2 is connected has a waste developer carrying portion 301 extending backward. A pulley 302 as one example of the driven transmission member is supported at the upper back end of the waste developer carrying portion 301. The pulley 302 transmits the driving to the carrying member, not shown, which carries forward the developer within the waste developer carrying portion 301. A withdrawal container 303 is supported in the front of the waste developer carrying portion 301, and the developer and the residue from the waste developer carrying portion 301 are withdrawn into the withdrawal container 303.

The waste developer carrying device UH is composed of the image forming apparatus carrying portion UH1, the drop-off carrying portion UH2 and the waste developer withdrawal portion UH3. In the waste developer carrying device UH, a drive belt 304 as one example of a band-like drive transmission member is wound around the pulley portion 114*b* of the image forming apparatus carrying portion UH1, the pulley 226*a* of the drop-off carrying portion UH2 and the pulley 302 of the waste developer withdrawal portion UH3, in which if the pulley portion 114*b* is rotated along with the rotation of the drive gear 111 for the image forming apparatus carrying portion UH1, the pulley 226*a* and the pulley 302 are rotated via the drive belt 304. In the example 1, the pulley 226*a* is set to be rotated counterclockwise as seen from the back.

ACTION OF EXAMPLE 1

FIGS. 6A to 6L are action explanatory views of the holding member, the first crushing member and the second crushing member as seen from the back.

Figure 6A:
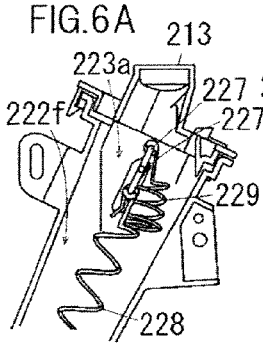
FIG. 6A is an action explanatory view of a holding member, a first crushing member and a second crushing member as seen from the back, which a second coil spring is protruded downward along the main conveying path to the maximum.

FIG. 6A is an explanatory view of a state where the second coil spring is protruded downward along the main conveying path to the maximum.

Figure 6B:
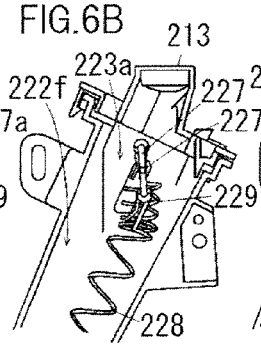
FIG. 6B is an explanatory view of a state where a crank is moved by 30° from FIG. 6A.

FIG. 6B is an explanatory view of a state where the crank is moved by 30° from FIG. 6A.

Figure 6C:
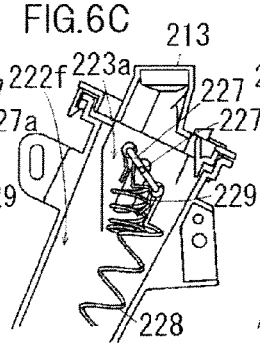
FIG. 6C is an explanatory view of a state where the crank is moved by 30° from FIG. 6B.

FIG. 6C is an explanatory view of a state where the crank is moved by 30° from FIG. 6B.

Figure 6D:
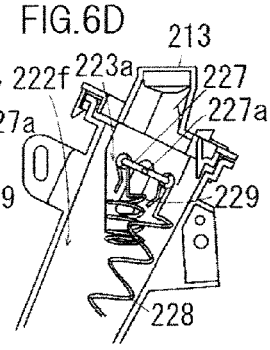
FIG. 6D is an explanatory view of a state where the crank is moved by 30° from FIG. 6C and in which the second coil spring is closest to the left wall portion of the main conveying path.

FIG. 6D is an explanatory view of a state where the crank is moved by 30° from FIG. 6C and in which the second coil spring is closest to the left wall portion of the main conveying path.

Figure 6E:
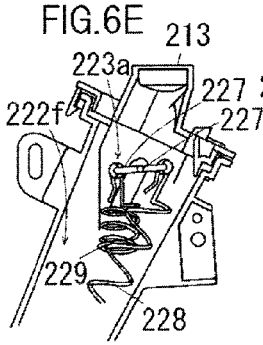
FIG. 6E is an explanatory view of a state where the crank is moved by 30° from FIG. 6D.

FIG. 6E is an explanatory view of a state where the crank is moved by 30° from FIG. 6D.

Figure 6F:
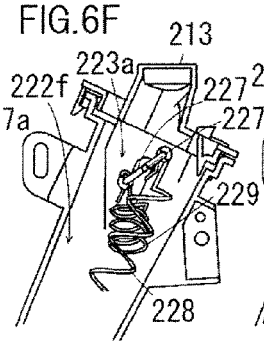
FIG. 6F is an explanatory view of a state where the crank is moved by 30° from FIG. 6E and in which a first coil spring contacts the second coil spring.

FIG. 6F is an explanatory view of a state where the crank is moved by 30° from FIG. 6E and in which the first coil spring contacts the second coil spring.

Figure 6G:
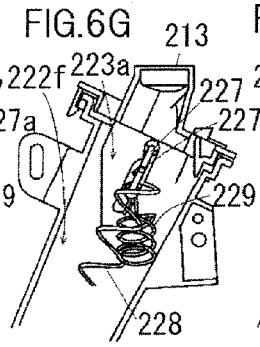
FIG. 6G is an explanatory view of a state where the crank is moved by 30° from FIG. 6F and in which the second coil spring is moved upward along the main conveying path to the maximum.

FIG. 6G is an explanatory view of a state where the crank is moved by 30° from FIG. 6F and in which the second coil spring is moved upward along the main conveying path to the maximum.

Figure 6H:
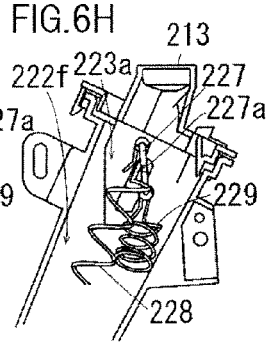
FIG. 6H is an explanatory view of a state where the crank is moved by 30° from FIG. 6G and in which the first coil spring is separated away from the second coil spring.

FIG. 6H is an explanatory view of a state where the crank is moved by 30° from FIG. 6G and in which the first coil spring is separated away from the second coil spring.

Figure 6I:
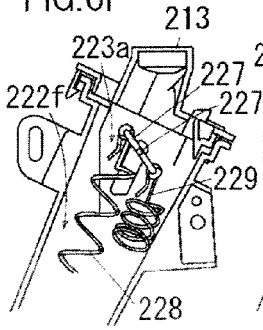
FIG. 6I is an explanatory view of a state where the crank is moved by 30° from FIG. 6H.

FIG. 6I is an explanatory view of a state where the crank is moved by 30° from FIG. 6H.

Figure 6J:
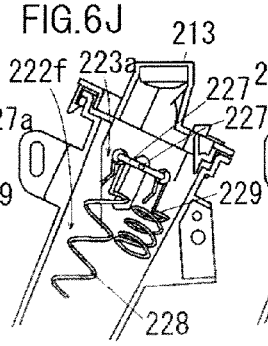
FIG. 6J is an explanatory view of a state where the crank is moved by 30° from FIG. 6I and in which the second coil spring is closest to the right wall portion of the main conveying path.

FIG. 6J is an explanatory view of a state where the crank is moved by 30° from FIG. 6I and in which the second coil spring is closest to the right wall portion of the main conveying path.

Figure 6K:
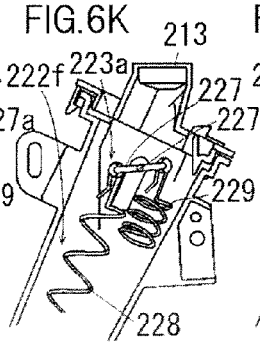
FIG. 6K is an explanatory view of a state where the crank is moved by 30° from FIG. 6J.

FIG. 6K is an explanatory view of a state where the crank is moved by 30° from FIG. 6J.

Figure 6L:
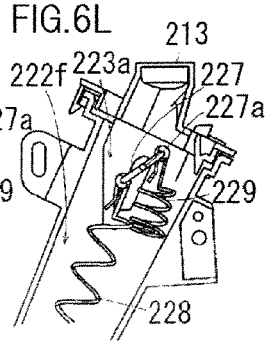
FIG. 6L is an explanatory view of a state where the crank is moved by 30° from FIG. 6K and one circle is made if the crank is further moved by 30°.
Figure 6L:
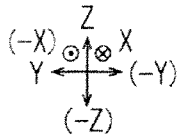

FIG. 6L is an explanatory view of a state where the crank is moved by 30° from FIG. 6K and one circle is made if the crank is further moved by 30°.

FIG. 7A to 7L are action explanatory views of the essence of the holding member, the first crushing member and the second crushing member of FIG. 5C. FIGS. 7A to 7L are action explanatory views of the states corresponding to FIGS. 6A to 6L, in which the crank is moved by every 30°.

FIGS. 8A to 8L are action explanatory views of the holding member, the first crushing member and the second crushing member, as seen from the front upper right. FIGS. 8A to 8L are action explanatory views of the states corresponding to FIGS. 6A to 6L, in which the crank is moved by every 30°.

In the image forming apparatus U of the example 1 with the above constitution, the waste developer carrying device UH is driven as the image forming operation proceeds. That is, if the drive gear 111 of the image forming apparatus carrying portion UH1 is driven, the developing device discharge gear of each color G102 to G152, the cleaner unit discharge gear G103 to G143 of each color, the photoconductor carrying path gear G143 and the belt drive member 114 are driven via the shaft 112 and the transmission gears G101 to G151. Also, the pulley 226*a* and the pulley 302 are rotated via the drive belt 304 by the pulley portion 114*b* of the belt drive member 114.

Thereby, the residue withdrawn from the photoconductor drum Pk to Py by the cleaner CLk to CLy is carried through the cleaner unit carrying path 103*k* to 103*y* to the photoconductor carrying path 102. Also, the developer containing the depleted carrier discharged from the developing device GK to GY is carried through the developing device carrying path 104*k* to 104*y* to the photoconductor carrying path 102. And the so-called waste developer carried to the photoconductor carrying path 102 is carried through the photoconductor carrying path 102 to the drop-off carrying portion main body 201 of the drop-off carrying portion UH2. In this case, the waste developer carried by the photoconductor carrying path auger 102*a* wound right-handed and rotated clockwise in FIG. 4B is carried too far to the front side of the photoconductor carrying path 102 to flow into the second inflow port 212. Accordingly, in the drop-off carrying portion UH2, the waste developer of the example 1 flowing from the photoconductor carrying path 102 into the second inflow port 212 drops on the main carrying path 222*f* to the side of the front wall portion 222*a*, where the second coil spring 228 is arranged, away from the back side bearing portion 224 on which the pulley 226*a* is supported. Thereby, there is less risk that the waste developer adheres to the back side bearing portion 224 to clog the second inflow port 212.

On the other hand, the residue removed from the intermediate transfer belt B by the intermediate transfer body cleaner CLB is carried through the intermediate transfer body carrying path 121 to the drop-off carrying portion UH2. In this case, the residue carried by the intermediate transfer body auger 122*a* wound right-handed and rotated clockwise as seen from the back is carried too far to the right side of the intermediate transfer body carrying path 121 to flow into the first inflow port 213. Accordingly, in the drop-off carrying portion UH2, the residue of the example 1 flowing from the intermediate transfer body carrying path 211 into the first inflow port 213 drops on the sub-carrying path 223*a* away from the back side bearing portion 224 mainly on the right side of the sub-carrying path 223*a*.

Figure 7A:
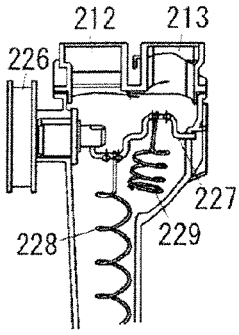
FIGS. 7A to 7L are action explanatory views of the essence of the holding member, the first crushing member and the second crushing member of FIG. 5C, which correspond action explanatory views of the states to FIGS. 6A to 6I, in which the crank is moved by every 30°.
Figure 7B:
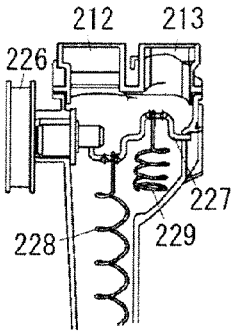
Figure 7C:
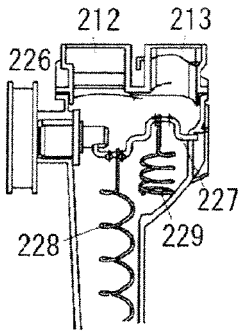
Figure 7D:
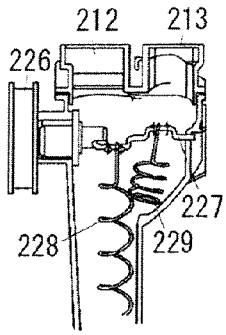
Figure 7E:
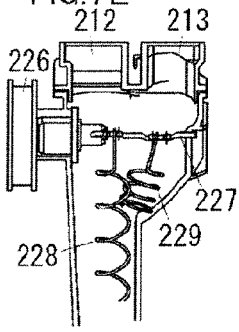
Figure 7F:
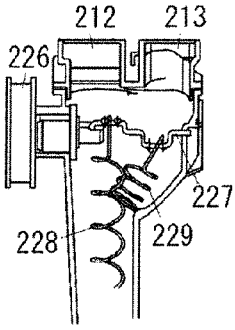
Figure 7G:
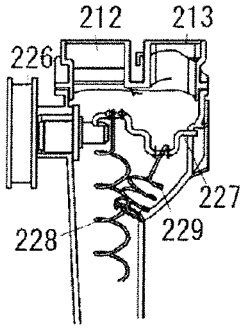
Figure 7H:
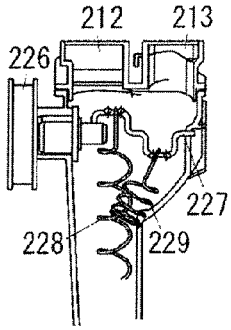
Figure 7I:
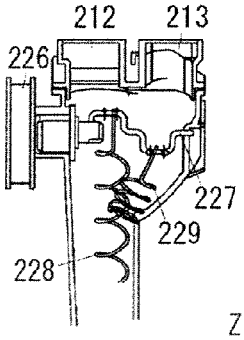
Figure 7J:
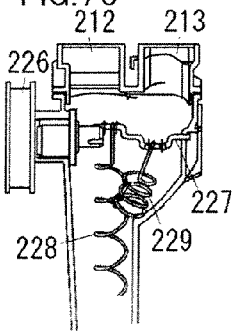
Figure 7K:
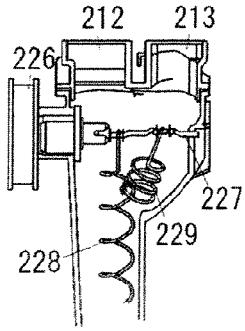
Figure 7L:
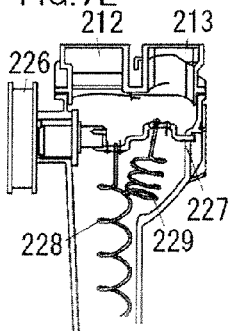
Figure 7L:
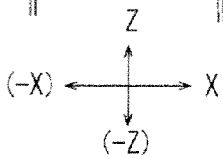
Figures 8A, 8B, 8C, 8D, 8E, 8F, 8G, 8H, 8I, 8J, 8K, 8L:
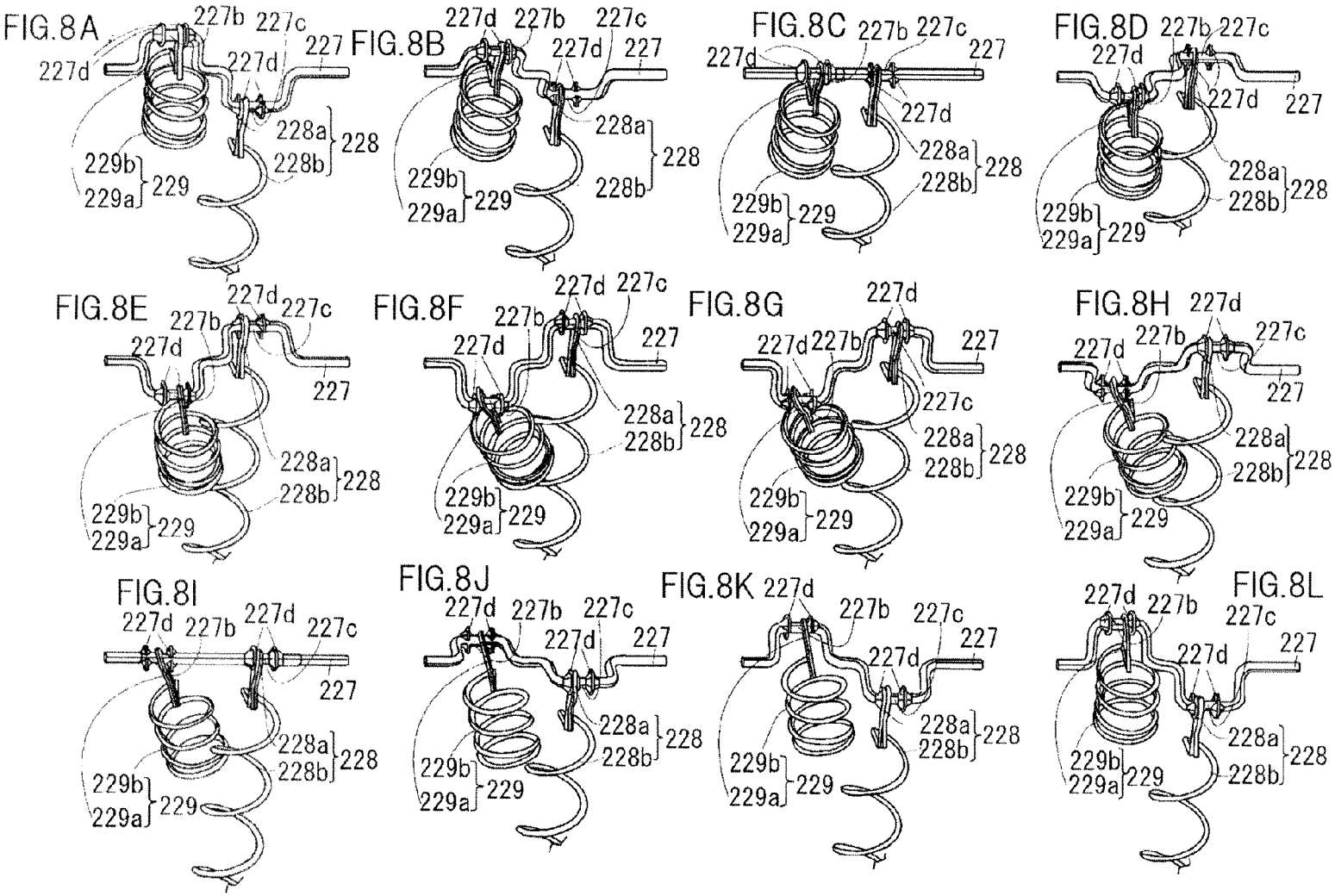
FIGS. 8A to 8L are an action explanatory views of the holding member, the first crushing member and the second crushing member, as seen from the front upper right, which correspond action explanatory views of the states to FIGS. 6A to 6L, in which the crank is moved by every 30°.

The waste developer flowing from the second inflow port 212 and dropping within the main carrying path 222*f* drops along the left wall portion 222*c* inclined downward in the vertical direction and is carried to the circular delivery pipe portion 222*e* in FIGS. 5B and 7L. Also, the residue flowing from the first inflow port 213 drops along the first inclined wall 223*c* of the sub-carrying path 223*a* to join the main carrying path 222*f*, drops down the main carrying path 222*f*, and is carried to the circular delivery pipe portion 222*e*.

The waste developer carried to the circular delivery pipe portion 222*e* is carried to the waste developer carrying portion 301 of the waste developer withdrawal portion UH3. And the waste developer is carried to the withdrawal container 303 and withdrawn by the waste developer carrying portion 301.

In FIGS. 6A to 8L, in the waste developer carrying device UH of the example 1, the crank 227 on which the second coil spring 228 and the first coil spring 229 are supported is rotated counterclockwise as seen from the back by the pulley 226*a* in the drop-off carrying portion UH2 as shown in FIG. 6A to 6L. Accordingly, the second coil spring 228 supported rotatably by the crank 227 is reciprocated along the main carrying path 222*f*, and the first coil spring 229 is reciprocated within the sub-carrying path 223*a*. Hence, the developer within the main carrying path 222*f* and the sub-carrying path 223*a* that adheres to the wall surface and lumps is crushed. That is, the main carrying path 222*f* and the sub-carrying path 223*a* are prevented from being clogged by the developer.

Also, in the sub-carrying path 223*a*, the first coil spring 229 is moved down on the right side of the sub-carrying path 223*a*, and moved up on the left side of the sub-carrying path 223*a*. And when the first coil spring 229 is moved down on the right side of the sub-carrying path 223*a*, the lower end of the first coil spring main body 229*b* contacts the first inclined wall 223*c*, and is guided to enter the main carrying path 222*f*. Accordingly, the developer within the sub-carrying path 223*a* is carried to the main carrying path 222*f* to be scraped off while being crushed by the first coil spring 229 moved down on the right side of the sub-carrying path 223*a* on which the residue flowing through the first inflow port 213 drops too far. Hence, there is less inflow developer soaring to become like a so-called cloud than the case where the first coil spring 229 is moved up on the side where the developer flows in too far through the first inflow port 213 upward. Accordingly, there is less soaring developer that adheres to the wall surface, whereby the developer adhering to the front side bearing portion 225 has less adverse influence on the rotation of the crank 227, and carrying the developer is aided by the first coil spring 229.

Also, if the first coil spring 229 enters the main carrying path 222*f*, the first coil spring main body 229*b* contacts the second coil spring main body 228*b*, as shown in FIGS. 6F to 6H, FIGS. 7F to 7H and FIGS. 8F to 8H. Thereby, a non-periodic motion with vibration or swing, in addition to a periodic reciprocating motion between the upper right and the lower left by the crank 227, is applied to the second coil spring 228 and the first coil spring 229. Accordingly, the developer is crushed more efficiently than the crushing member with the periodic reciprocating motion only, and there is less clogging of developer. Further, the second coil spring 228 and the first coil spring 229 are supported with a looseness by the crank 227, and more likely to make the non-periodic motion than without looseness. Also, since the second coil spring 228 and the first coil spring 229 vibrate or swing, the developer adhering to the second coil spring 228 and the first coil spring 229 themselves is shaken, and less likely to grow like a lump.

Further, in the image forming apparatus U of the example 1, the residual developer withdrawn by the intermediate transfer body cleaner CLB is subjected to a transfer voltage multiple times in passing through the primary transfer areas Q3*y* to Q3*k* and the secondary transfer area Q4. Accordingly, the developer withdrawn by the intermediate transfer body cleaner CLB to flow into the first inflow port 213 has worse fluidity and is more likely to clog than the developer withdrawn by the cleaners CLy to CLk for the image bearing members Py to Pk and passing through the transfer area only once. On the contrary, in the example 1, the developer with relatively low fluidity withdrawn by the intermediate transfer body cleaner CLB to flow into the first inflow port 213 is crushed by the first coil spring 229 having a shorter length, lighter weight and larger vibration at the time of contact than the second coil spring 228, thereby preventing clogging of the developer.

When the second coil spring 228 and the first coil spring 229 are contacted, the second coil spring 228 is moved to the upper right and the first coil spring 229 is moved to the lower left, so as to approach each other, as shown in FIGS. 6F to 6H, FIGS. 7F to 7H and FIGS. 8F to 8H. At this time, since the first coil spring comes into contact with the second coil spring 228 while being moved from Y to −Y, after the first coil spring 229 contacts the second coil spring 228, the second coil spring 228 is moved to the upper right and the first coil spring 229 is moved to the lower left, the second coil spring main body 228*b* is guided and moved in the direction along the inclination formed by the wire rod of the second coil spring main body 228*b*, in which the first coil spring 227 is spirally wounded right-handed to guide along the direction where the first coil spring 227 is moved relative to the second coil spring 228. Accordingly, the collision when the first coil spring 229 contacts the second coil spring 228 is weaker to have longer life than the case where the second coil spring 228 is wound left-handed in reverse direction to the right-handed twining, whereby the spiral second coil spring 228 and the wire rod of the first coil spring 229 are prevented from being entangled to be immovable.

Also, the first coil spring main body 229*b* having a larger diameter D than the pitch P of the second coil spring main body 228*b* is less likely to be intertwined, because the first coil spring 229 is inclined vertically to the second coil spring 228 to have the entire lower end entering into one turn of the wire rod of the second coil spring main body 228*b*. Thereby, a part of the lower end of the first coil spring main body 229*b* makes contact and is moved to cross the wire rod of the second coil spring main body 228*b* and separated away from the second coil spring 228 as shown in FIGS. 6F to 6H, FIGS. 7F to 7H and FIGS. 8F to 8H. Accordingly, the second coil spring 228 and the first coil spring 229 are vibrated without being entangled upon contact while being reciprocated periodically by the crank 227, stably crushing the developer over time to prevent clogging of the developer.

MODIFICATION EXAMPLE

Though the example of the invention has been detailed above, the invention is not limited to the above example, but various modifications may be made without departing from the spirit or scope of the invention. The modifications (H01) to (H08) of the invention will be exemplified below.

(H01) Though the copying machine U has been exemplified as one example of the image forming apparatus in the above example, the invention is not limited to the above example, but may be applicable to a printer, a FAX, or a multi-function apparatus having these multiple functions. Also, the invention is not limited to the image forming apparatus of polychromatic development, but may be applicable to the single color or so-called monochromatic image forming apparatus.

(H02) Though the waste developer is carried in the waste developer carrying device UH as one example of the developer carrying apparatus in the above example, the invention is not limited to the above example, the developer carrying apparatus of the invention may be applied on the carrying path for supplying the developer, for example.

(H03) Though the residual developer from the intermediate transfer body flows into the first inflow port on the side of the first crushing member and the residual developer from the developing device flows into the second inflow port on the side of the second crushing member in the above example, the invention is not limited to the above example, but the residual developer from the intermediate transfer body may flow into the second inflow port on the side of the second crushing member and the residual developer from the developing device may flow into the first inflow port on the side of the first crushing member.

(H04) Though the waste developer carrying device UH is formed with two inflow ports in the above example, the invention is not limited to the above example, but the waste developer carrying device UH may have one inflow port or three or more inflow ports. For example, the developer from each cleaner CLy to CLk may directly flow into the drop-off path.

(H05) Though the so-called auger having the rotation shaft and the carrying blade as the first carrying member and the second carrying member has been exemplified in the above example, the invention is not limited to the above example, but a coiled carrying member in which the wire rod is spirally wound as well known may be adopted.

(H06) Though the double crank with different phase of 180° as one example of the holding member has been employed in the above example, the invention is not limited to the above example, but the crank with the same phase may be employed.

(H07) Though the developer drops at eccentric position of the coil spring 228, 229 depending on the winding direction of the carrying blade for the auger 107, 122 in the above example, the invention is not limited to this constitution, the developer may drop at eccentric position of the coil spring 228, 229 by forming the inflow port 213, 212 at the position eccentric to the arranged position of the coil spring 228, 229.

Figure 9:
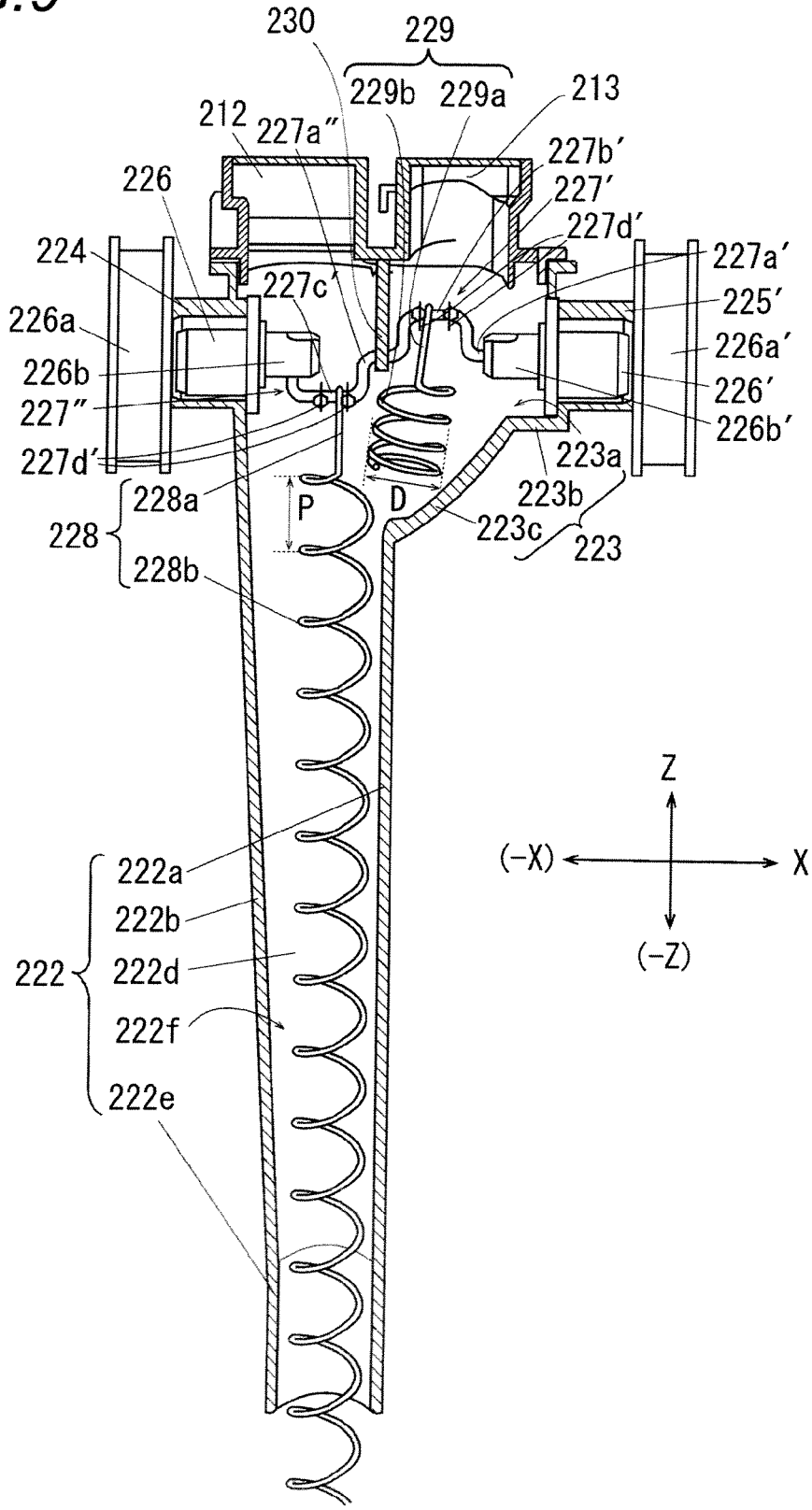
FIG. 9 is an explanatory view of the modification of the example 1, corresponding to FIG. 5C of the example 1.

FIG. 9 is an explanatory view of the modification of the example 1, corresponding to FIG. 5C of the example 1.

(H08) Though the first coil spring 229 and the second coil spring 228 are held in one crank 227 in the above example, the invention is not limited to this constitution, the coil springs 228 and 229 may be held by two holding members separately constructed.

For example, a front side bearing portion 225' longitudinally in symmetry to the back side bearing portion 224, instead of the front side bearing portion 225 of the example 1, is formed on the front wall portion 223*b*, and the intermediate bearing portion 230 is formed between the front side bearing portion 225' and the back side bearing portion 224 and between the main carrying path 222*f* and the sub-carrying path 223*a* in FIG. 9. The front side bearing portion 225' supports rotatably a first shaft support member 226' arranged longitudinally in symmetry to the shaft support member 226. And a first crank 227' as one example of the first holding member having both ends supported by the first shaft support member 226' and the intermediate bearing portion 230 and a second crank 227" as one example of the second holding member having both ends supported by the second shaft support member 226 and the intermediate bearing portion 230 are arranged, instead of the crank 227 of the example 1 integrally constructed. The first crank 227' has a rotation center portion 227*a'*, a first coil spring support portion 227*b'* and a coil spring movement regulation member 227*d'* as in the example 1, and the second crank 227" has a rotation center portion 227*a"*, a second coil spring support portion 227*c'* and a coil spring movement regulation member 227*d'* as in the example 1.

Accordingly, if the driving is transmitted to the pulley 226*a'* of the first shaft support member 226', the first crank 227' is rotated, so that the first coil spring 229 is reciprocated, and if the driving is transmitted to the pulley 226*a* of the second shaft support member 226, the second crank 227" is rotated, so that the second coil spring 228 is reciprocated. The pulley 226*a*' may be driven by another drive motor, not shown, or may transmit the driving from the same drive motor as for the pulley 226*a*. Also, in this modification, the rotational direction of the pulley 226*a*' and the pulley 226' is desirably set to be counterclockwise as seen from the back as in the example 1, but may be different depending on the constitution.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder transporting device comprising:

a drop path that allows powder to drop;

a first crushing member that is located in the drop path and crushes a powder cohesion in the drop path by reciprocating along the drop path; and a second crushing member that is located in the drop path that crushes the powder cohesion in the drop path by reciprocating along the drop path, wherein when the first crushing member moves toward a downstream side in a dropping direction of the powder in the drop path, a tip of the first crushing member at the downstream side in a dropping direction is inclined to a side where the second crushing member is located, and comes in contact with the second crushing member.

2. The powder transporting device according to claim 1 wherein when the first crushing member moves toward the downstream side in a dropping direction in the drop path, the first crushing member comes in contact with an inner wall surface of the drop path.

3. The powder transporting device according to claim 2, further comprising:

a retention member, wherein the drop path has a first drop path that allows the powder to drop and a second drop path that is merged with a downstream end of the first drop path in a dropping direction of the powder and that allows powder to drop therein, the first crushing member is located in the first drop path, the second crushing member is located in the second drop path, the retention members reciprocates the first and second crushing member by retaining and rotating the first and second crushing members, and a wall surface of the first drop path is formed to be inclined to the second drop path.

4. A powder transporting device comprising:

a drop path having a first drop path that allows powder to drop therein, a second drop path that is merged with the first drop path and allows powder to drop therein, and an inclined wall that is formed in the first drop path and inclined to the second drop path;

a first crushing member that is located in the first drop path and crushes the powder cohesion in the first drop path by reciprocating between a first upper end position and a first lower end position along the first drop path, wherein when the first crushing member is located at the first lower end position, the first crushing member comes in contact with the inclined wall and a tip of the first crushing member in the downstream side in a dropping direction of the powder inclines to a side where a second crushing member is located;

the second crushing member that is located in the second drop path and crushes the powder cohesion in the second drop path by reciprocating between a second upper end position and a second lower end position along the second drop path, wherein the second crushing member comes in contact with the first crushing member inclined to the second drop path at the first lower end position; and a retention members that reciprocates the first and second crushing member by retaining and rotating the first and second crushing members.

5. The powder transporting device according to claim 3 wherein the retention member including:

a rotation shaft section serving as a rotation center while the retention member rotates;

a first crushing member support section that supports the first crushing member at a position that is shifted in a radial direction from the rotation shaft section; and a second crushing member support section that supports the second crushing member at a position different in phase from the first crushing member support section along the rotation direction of the retention member.

6. The powder transporting device according to claim 4 wherein the retention member including:

a rotation shaft section serving as a rotation center while the retention member rotates;

a first crushing member support section that supports the first crushing member at a position that is shifted in a radial direction from the rotation shaft section; and a second crushing member support section that supports the second crushing member at a position different in phase from the first crushing member support section along the rotation direction of the retention member.

7. The powder transporting device according to claim 1 wherein a reciprocating direction of the first crushing member differs from a reciprocating direction of the second crushing member.

8. The powder transporting device according to claim 3 wherein a reciprocating direction of the first crushing member differs from a reciprocating direction of the second crushing member.

9. The powder transporting device according to claim 1 wherein the first crushing member is formed by spirally winding a first wire rod, and wherein the second crushing member is formed by spirally winding a second wire rod and the second wire rod is wound in such a direction that the first crushing member being in contact with the second crushing member is guided along a direction in which the first crushing member relatively moves to the second crushing member.

10. The powder transporting device according to claim 3 wherein the first crushing member is formed by spirally winding a first wire rod, and wherein the second crushing member is formed by spirally winding a second wire rod and the second wire rod is wound in such a direction that the first crushing member being in contact with the second crushing member is guided along a direction in which the first crushing member relatively moves to the second crushing member.

11. The powder transporting device according to claim 4 wherein the first crushing member is formed by spirally winding a first wire rod, and wherein the second crushing member is formed by spirally winding a second wire rod and the second wire rod is wound in such a direction that the first crushing member being in contact with the second crushing member is guided along a direction in which the first crushing member relatively moves to the second crushing member.

12. The powder transporting device according to claim 1, further comprising:

a first inflow port that is located above the first crushing member and allows the powder to flow into the drop path, wherein the powder flows from the first inflow port with being shifted to one side of a direction perpendicular to the dropping direction of the drop path, and wherein the first crushing member reciprocates downward in a gravity direction along the dropping direction on the side to which the powder is shifted.

13. The powder transporting device according to claim 1, further comprising:

a first inflow port that is formed above the first crushing member and allows the powder to flow into the drop path, a first powder carrying path that is connected to the first inflow port and carries the powder therein, and a first powder carrying member that has a rotation shaft and a carrying blade supported spirally on an outer periphery of the rotation shaft and is located in the first powder carrying path, the first powder carrying member that rotates to carry the powder in the first powder carrying path, wherein the first powder carrying member rotates to a lower side in a gravity direction, rotates to a side where the first crushing member moves downward in the gravity direction along the dropping direction, and rotates upward in the gravity direction in turn.

14. The powder transporting device according to claim 1, further comprising:

a second inflow port that is located above the second crushing member and allows the powder to flow into the drop path, wherein the powder flows from the second inflow port with being shifted to one side of a direction perpendicular to the dropping direction of the drop path, and wherein the second crushing member reciprocates downward in a gravity direction along the dropping direction on the side to which the powder is shifted.

15. The powder transporting device according to claim 1, further comprising:

a second inflow port that is formed above the second crushing member and allows the powder to flow into the drop path, a second powder carrying path that is connected to the second inflow port and carries the powder therein, and a second powder carrying member that has a rotation shaft and a carrying blade supported spirally on an outer periphery of the rotation shaft and is located in the second powder carrying path, the second powder carrying member that rotates to carry the powder in the second powder carrying path, wherein the second powder carrying member rotates to a lower side in a gravity direction, moves to a side where the second crushing member moves downward in the gravity direction along the dropping direction, and moves upward in the gravity direction in turn.

16. An image forming apparatus comprising:

a plurality of image carriers;

a plurality of developing units that develop latent images on a surface of the corresponding image carriers into visible images;

image carrier cleaners that remove a developer remaining on the surfaces of the image carriers after the visible images are transferred to clean the image carriers;

a first remaining developer carrying path that carries the developer removed by the image carrier cleaners;

an intermediate transfer body that is located facing the image carriers and wherein the visible images on the surfaces of the image carriers are transferred to the intermediate transfer body;

a plurality of primary transfer devices that transfer the visible images on the surfaces of the image carriers to the intermediate transfer body;

a secondary transfer device that transfers the visible image on a surface of the intermediate transfer body to a medium;

an intermediate transfer body cleaner that removes the developer deposited on the surface of the intermediate transfer body after the visible image is transferred to the medium by the secondary transfer device;

a second remaining developer carrying path that carries the developer removed from the intermediate transfer body;

a drop path having a first drop path that allows the developer carried by the second remaining developer carrying path to drop therein, and a second drop path that is merged with a downstream end of the first drop path in a dropping direction of the developer and allows the developer carried by the first remaining developer carrying path to drop therein;

a first crushing member that is located in the first drop path and crushes a powder cohesion in the first drop path by reciprocating along the drop path; and a second crushing member that located in the second drop path that crushes the powder cohesion in the second drop path by reciprocating along the drop path, a retention member that reciprocates the first and second crushing member by retaining and rotating the first and second crushing member, a wall surface of the first drop path that is formed to be inclined to the second drop path, and wherein when the first crushing member that reciprocates in response to rotation of the retention member moves toward a downstream side in the dropping direction of the developer in the first drop path, the first crushing member comes in contact with the inclined wall surface of the first drop path, whereby a tip of the first crushing member at the downstream side in a dropping direction is inclined to a side where the second crushing member is located and comes in contact with the second crushing member in the second drop path.

17. The powder transporting device according to claim 16, further comprising:

a retention member, wherein the drop path has a first drop path that allows the powder to drop and a second drop path that is merged with a downstream end of the first drop path in a dropping direction of the powder and that allows powder to drop therein, the first crushing member is located in the first drop path, the second crushing member is located in the second drop path, the retention member reciprocates the first and second crushing members by retaining and rotating the first and second crushing members, and a wall surface of the first drop path is formed to be inclined to the second drop path.

18. The powder transporting device according to claim 16 wherein the retention member including:

a rotation shaft section serving as a rotation center while the retention member rotates;

a first crushing member support section that supports the first crushing member at a position that is shifted in a radial direction from the rotation shaft section; and a second crushing member support section that supports the second crushing member at a position different in phase from the first crushing member support section along the rotation direction of the retention member.

19. The powder transporting device according to claim 16 wherein a reciprocating direction of the first crushing member differs from a reciprocating direction of the second crushing member.

20. The powder transporting device according to claim 16 wherein the first crushing member is formed by spirally winding a first wire rod, and wherein the second crushing member is formed by spirally winding a second wire rod and the second wire rod is wound in such a direction that the first crushing member being in contact with the second crushing member is guided along a direction in which the first crushing member relatively moves to the second crushing member.

* * * * *